US006935029B2

(12) United States Patent
Morisugi et al.

(10) Patent No.: US 6,935,029 B2
(45) Date of Patent: Aug. 30, 2005

(54) DRY SHAVER WITH A TRIMMER

(75) Inventors: Kazuhiro Morisugi, Inugami-gun (JP); Masanobu Yamasaki, Hikone (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 10/481,023

(22) PCT Filed: Jun. 13, 2003

(86) PCT No.: PCT/JP03/07583

§ 371 (c)(1),
(2), (4) Date: Dec. 17, 2003

(87) PCT Pub. No.: WO03/106117

PCT Pub. Date: Dec. 24, 2003

(65) Prior Publication Data

US 2004/0163257 A1 Aug. 26, 2004

(30) Foreign Application Priority Data

Jun. 17, 2002 (JP) ..... 2002-176445

(51) Int. Cl.[7] ..... B26B 19/10
(52) U.S. Cl. ..... 30/43.92; 30/34.1
(58) Field of Search ..... 30/34.1, 43.1, 30/43.9, 43.96, 43.92

(56) References Cited

U.S. PATENT DOCUMENTS 4,797,997 A * 1/1989 Packham et al. ..... 30/43.92
4,930,217 A 6/1990 Wolf et al.
5,257,456 A * 11/1993 Franke et al. ..... 30/43.92
5,343,621 A * 9/1994 Hildebrand et al. ..... 30/43.92
5,459,927 A * 10/1995 Kauer et al. ..... 30/43.1
5,704,126 A * 1/1998 Franke et al. ..... 30/34.1
6,226,869 B1 * 5/2001 Heintke et al. ..... 30/34.1
6,601,302 B2 * 8/2003 Andrew ..... 30/34.1
6,739,054 B2 * 5/2004 Oswald ..... 30/34.1
2001/0003228 A1 6/2001 Van Hout et al.
2004/0010919 A1 * 1/2004 Shiba et al. ..... 30/43.92
2004/0055158 A1 * 3/2004 Izumi et al. ..... 30/43.92

FOREIGN PATENT DOCUMENTS

| | | |
|---|---|---|
| EP | 0 721 824 | 7/1996 |
| JP | 4-132581 | 5/1992 |
| WO | 03 041918 | 5/2003 |

* cited by examiner

*Primary Examiner*—Hwei-Siu Payer
(74) *Attorney, Agent, or Firm*—Oblon, Spivak, McClelland, Maier & Neustadt, P.C.

(57) ABSTRACT

A dry shaver has a shaving head and a trimmer unit both movably supported to a hand grip. The shaving head includes a drive element for driving a cutter for shaving. The trimmer unit has a cutter which is connected to the drive element for trimming. A mechanism is provided to interlock the trimmer unit and the shaving head for holding the shaving head in a fixed position relative to the hand grip when the trimmer is in the operative position.

9 Claims, 13 Drawing Sheets

DRY SHAVER WITH A TRIMMER

TECHNICAL FIELD

The present invention is directed to a dry shaver with a trimmer, and more particularly to a dry shaver having a movable shaving head and a retractable trimmer.

BACKGROUND ART

As disclosed, for example, in JP4-132581, a prior dry shaver includes, in addition to a shaving head, a trimmer unit which is movable between a rest position and an operative position. The shaving head and the trimmer unit are both mounted on the upper end of a hand grip. The trimmer unit has a trimmer cutter which is driven by a common element intended for driving a cutter of the shaving head. Thus, the shaver is designed so that, when the trimmer unit comes into the operative position, the trimmer cutter becomes connected to the common element or the drive element for trimming. When the drive element is located at a fixed point on the hand grip, it is quite simple to transmit the motion of the drive element to the trimmer cutter moved into the operative position. However, if the shaving head is mounted to be movable relative to the hand grip and includes the drive element movable together with the shaving head relative to the hand grip, it becomes rather complicated to transmit the motion of the drive element successfully and consistently to the trimmer cutter in the operative position.

DISCLOSURE OF THE INVENTION

In view of the above problem, the present invention has been accomplished to provide a dry shaver with a trimmer which is capable of driving the trimmer cutter successfully and consistently with the use of the common drive element for shaving. The dry shaver in accordance with the present invention includes a hand grip, and a shaving head mounted on top of the hand grip so as to be movable relative thereto. The shaving head includes a cutter, a motor and a drive element which transmits a motion of the motor to the cutter for shaving. In addition, a trimmer unit is mounted on the side of the hand grip to be movable relative thereto between a rest position and an operative position. The trimmer unit includes a trimmer cutter which becomes connected to the drive element so as to be driven thereby for trimming only when the trimmer unit is moved into the operative position. The important feature of the present invention resides in that lock means or mechanism is provided to interlock the trimmer unit and the shaving head for holding the shaving head in a fixed position relative to the hand grip when the trimmer is in the operative position. Since the trimmer cutter is driven with the shaving head being fixed to the hand grip, i.e., with the drive element being located at a fixed position relative to the hand grip, the motion of the drive element can be transmitted uniformly and consistently to the trimmer cutter without suffering from any substantial attenuation or fluctuation of the motion which would otherwise occur if the shaving head moves when the trimmer unit is in the operative position.

The shaving head and the trimmer unit have a width axis along which the drive element and the trimmer cutter reciprocates, respectively. In a preferred embodiment, the shaving head is supported to the hand grip to swivel relative thereto about a pivot axis perpendicular to the width axis of the shaving head, and is biased into a neutral position where the shaving head has its width axis parallel with the axis of the trimmer unit. Thus, the full oscillation amplitude of the drive element can be transmitted for reciprocating the trimmer cutter.

The lock means is preferred to include a guide and a lock both formed on the side of the trimmer unit. The guide is kept in constant engagement with a support formed on the side of the hand grip for movably supporting the trimmer unit on the hand grip. The lock is provided to come into engagement with a catch formed on the side of the shaving head when the trimmer unit moves into the operative position, thereby locking the shaving head into the fixed position. The lock is engaged with the catch to hold the trimmer unit in a predetermined spaced relation to the shaving head to the shaving head, thereby stably retaining the trimmer unit in its operative position.

Preferably, the lock comprises a pair of lock members for engagement with a corresponding pair of catch members defining the catch. The lock members are spaced along the width axis by a distance of half or more of a width of the shaving head in order to lock the shaving head successfully or hold it free from moving relative to the hand grip when the trimmer unit is in the operative position.

In a preferred embodiment, the trimmer unit is slidably supported to the hand grip to be vertically movable between the rest position and the operative position along an upright axis of the hand grip. The lock members are each formed with a contact surface for friction engagement with the catch members. The contact surface is inclined with respect to the upright axis of the hand grip in such a direction that the lock members are released from the catch members when the shaving head is forced to swivel relative to the hand grip. Thus, even if an external force of moving the shaving head is applied while using the trimmer unit, the trimmer unit can be moved away from the operative position for releasing the shaving head, thereby protecting the parts that constitute the mechanism of holding the shaving head to the trimmer unit, as well as the parts responsible for the driving connection of the drive element to the trimmer cutter.

Preferably, the drive element is concealed behind a cover of the shaving head and is only accessible through a lower opening at the lower end of the cover. The trimmer unit is provided with a link for connection of the trimmer cutter to the drive element. The link includes a swing arm which is pivotally supported to the trimmer unit at a portion intermediate the upper end lower ends thereof, and which is connected at its upper end with the trimmer cutter. The link further also includes a coupler which extends integrally from the lower end of the swing arm upwardly in an overlapped relation with the swing arm. When the trimmer unit moves into the operative position, the coupler extends through the lower opening for engagement with the drive element behind the cover.

Alternatively, the link including may be composed of a first swing arm and a second swing arm. The first swing arm is pivotally supported to the trimmer unit at a portion intermediate the upper end lower ends thereof, and is connected at its upper end with the trimmer cutter. The second swing arm is pivotally supported to the trimmer unit at a portion intermediate the upper and lower ends thereof, and is pivotally connected at its lower end to the lower end of the first swing arm. The second swing arm is formed at its upper end with a coupler for detachable engagement with the drive element. With the combination of the first and second swing arms linking with each other, the trimmer cutter can have an optimum amplitude of oscillation from the drive element disposed on the side of the shaving head.

The trimmer unit may include a vibration absorbing member of an elastomeric material for reducing operation noise.

These and still other objects and advantageous features of the present invention will become more apparent from the following description of the preferred embodiment when taken in conjunction with the attached drawings.

MODE FOR CARRYING OUT THE INVENTION

Figure 1:
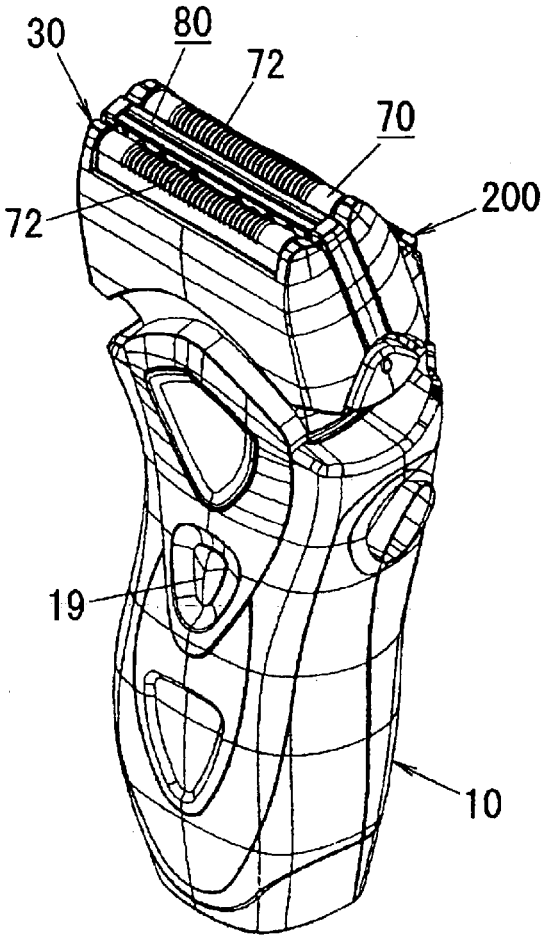
FIG. 1 is a perspective view of a dry shaver in accordance with a preferred embodiment of the present invention.
Figure 2:
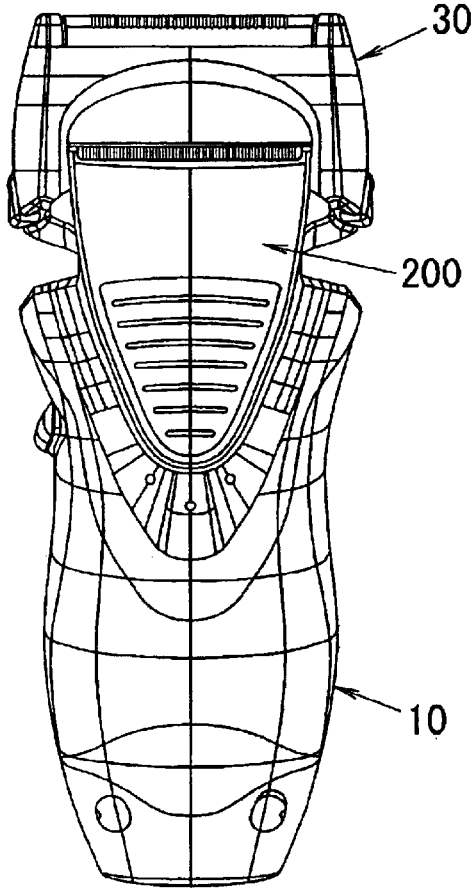
FIG. 2 is a rear view of the dry shaver.

Referring now to FIGS. 1 to 7, there is shown a dry shaver in accordance with a preferred embodiment of the present invention. The shaver comprises a hand grip 10 configured to be grasped by a user's hand, and a shaving head 30 carrying three parallel shaving units 70 and 80. Two outer ones of the shaving units 70 are designed for shaving relatively short hairs and each includes an outer cuter 72 and an inner cutter 78 driven to reciprocate in shearing contact with the outer cutter. The other center shaving unit 80 is designed for shaving relatively long hairs and includes an outer cutter 82 and an inner cutter 88 driven to reciprocate together with the inner cutters 78 in shearing engagement with the outer cutter 61. The outer cutters 72 of the two outer shaving units 70 and the center shaving unit 80 are integrated into a cutter holder 90 which is detachably coupled to the shaving head 30. The inner cutters 78 are detachably connected respectively to reciprocating drive elements 42 projecting on top of the shaving head 30. When the cutter holder 90 is attached to the shaving head 30, the inner cutter 88 of the center shaving unit 80 is drivingly connected to one of the drive elements 42 so as to reciprocate together with the other inner cutters 78. Also carried on the rear of the hand grip 10 is a trimmer unit 200 having a reciprocating trimmer cutter driven commonly by the drive element 42 for trimming the hairs.

The hand grip 10 is vertically elongated to have an upright axis and includes a water-tight housing 11 which accommodates therein rechargeable batteries 17. A switch button 19 is disposed on front of the hand grip 10 to activate a driving circuit for energizing a motor 40 to reciprocate the inner cutters. The shaving head 30 is elongated along its width axis to have a width greater than a height thereof. It is the width axis along which the inner cutters reciprocate for shaving the hairs. The shaving head 30 accommodates therein the motor 40 which is electrically connected by a flexible cable 44 to the driving circuit formed in the hand grip 10. The motor 40 is a linear reciprocating motor having two reciprocators carrying the drive elements 42 projecting on top of the shaving head 30. The shaving head 30 is formed separately from the hand grip 10 and is movably supported thereby by a support mechanism 100 so that the shaving head 30 is capable of effecting a combination of swiveling and depressing movements relative to the hand grip 10 in order to bring the shaving units 70 and 80 into smooth and effective shaving contact with various areas of the user's skin.

Figure 3:
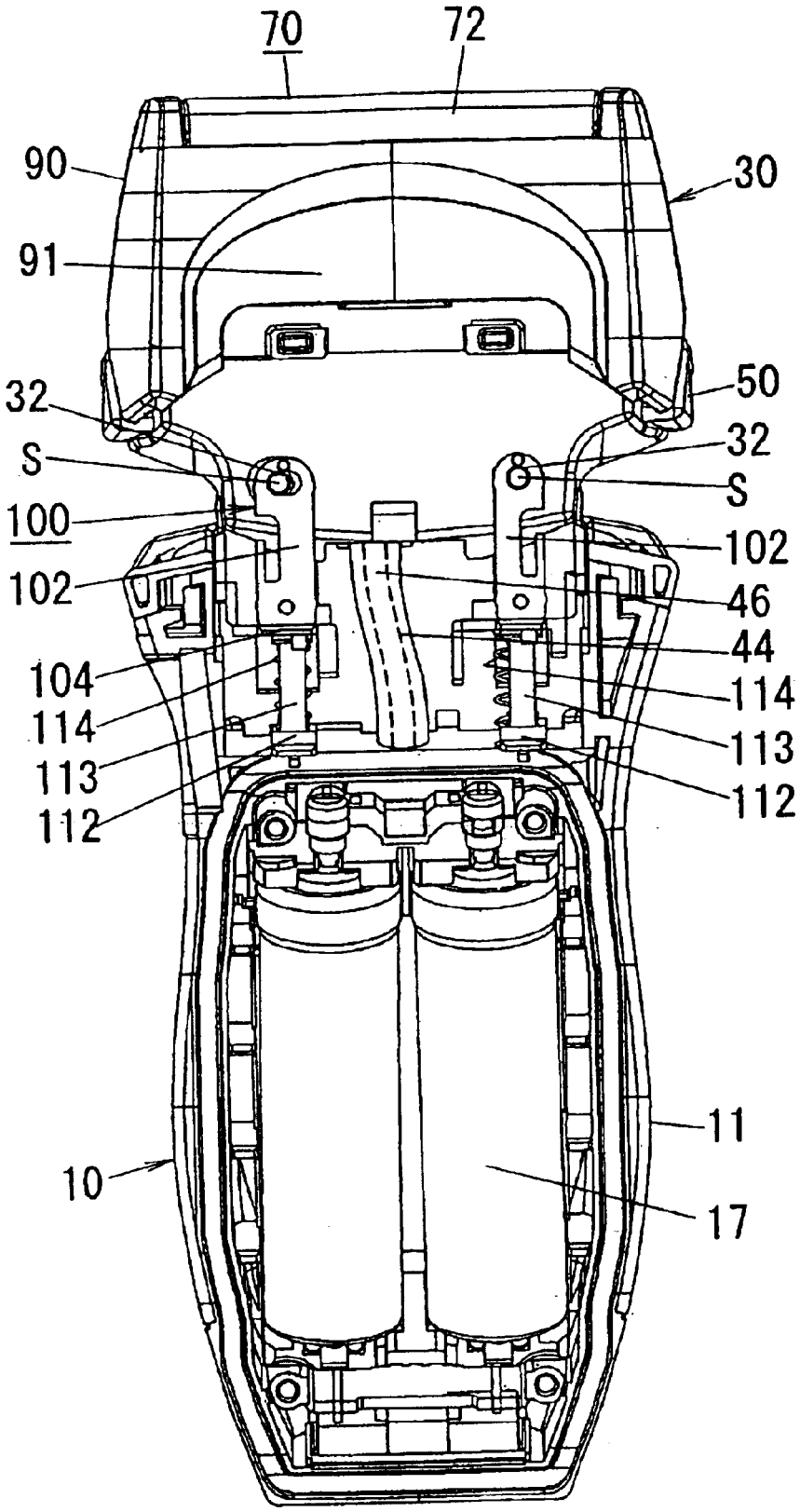
FIG. 3 is a rear view of the dry shaver shown with some portions being removed.
Figure 4:
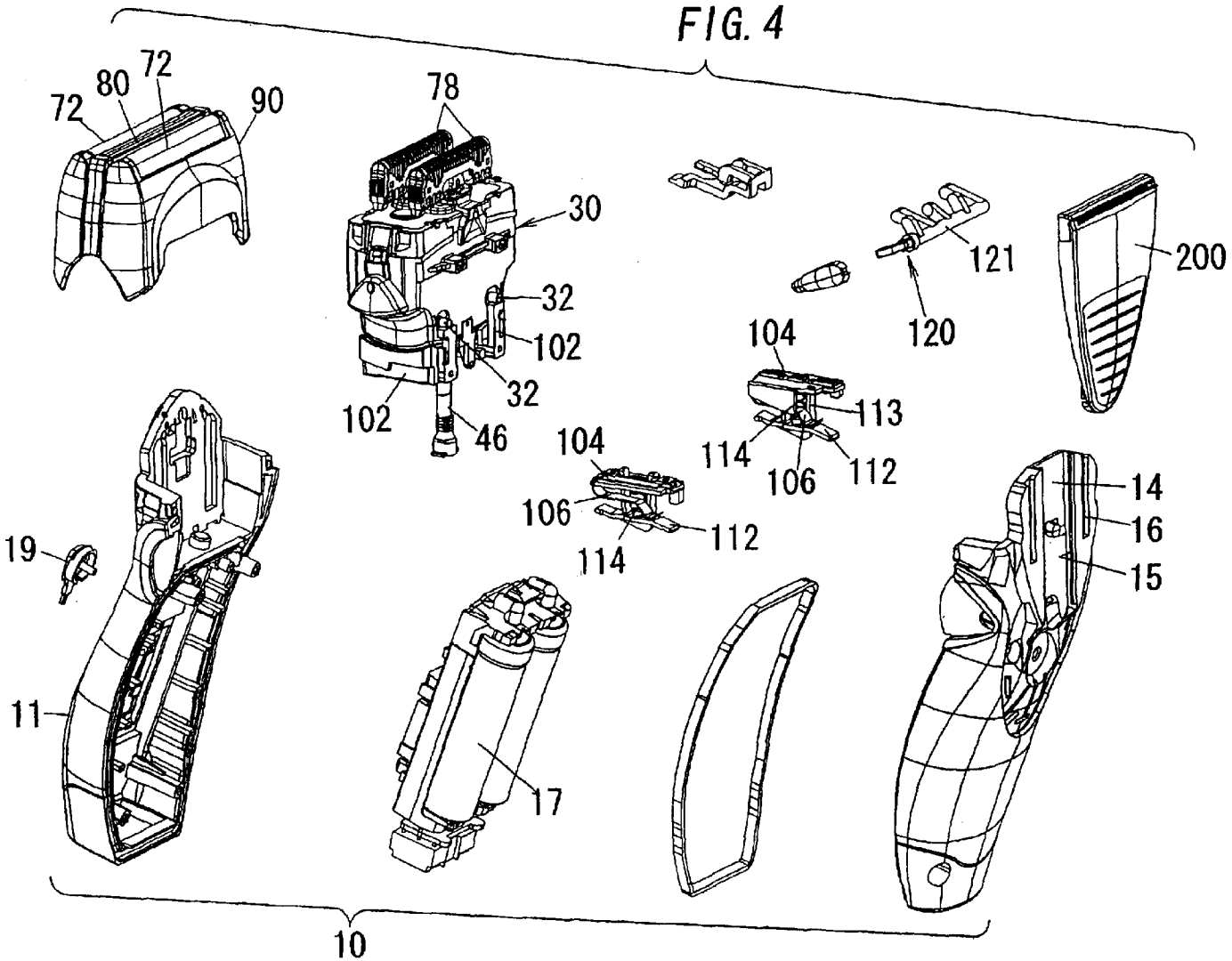
FIG. 4 is an exploded perspective view of the dry shaver.
Figure 5:
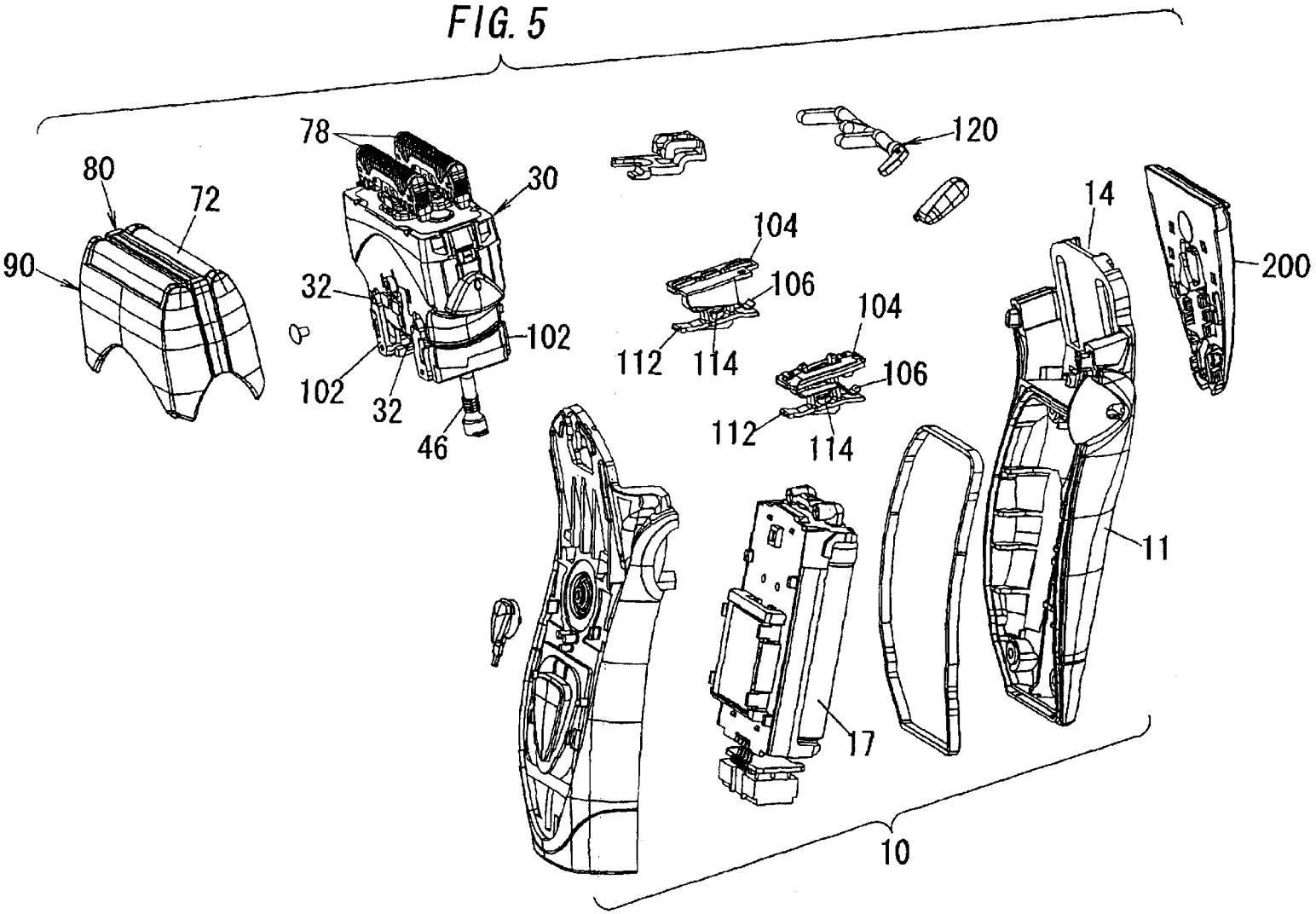
FIG. 5 is an exploded perspective view of the dry shaver.
Figure 6:
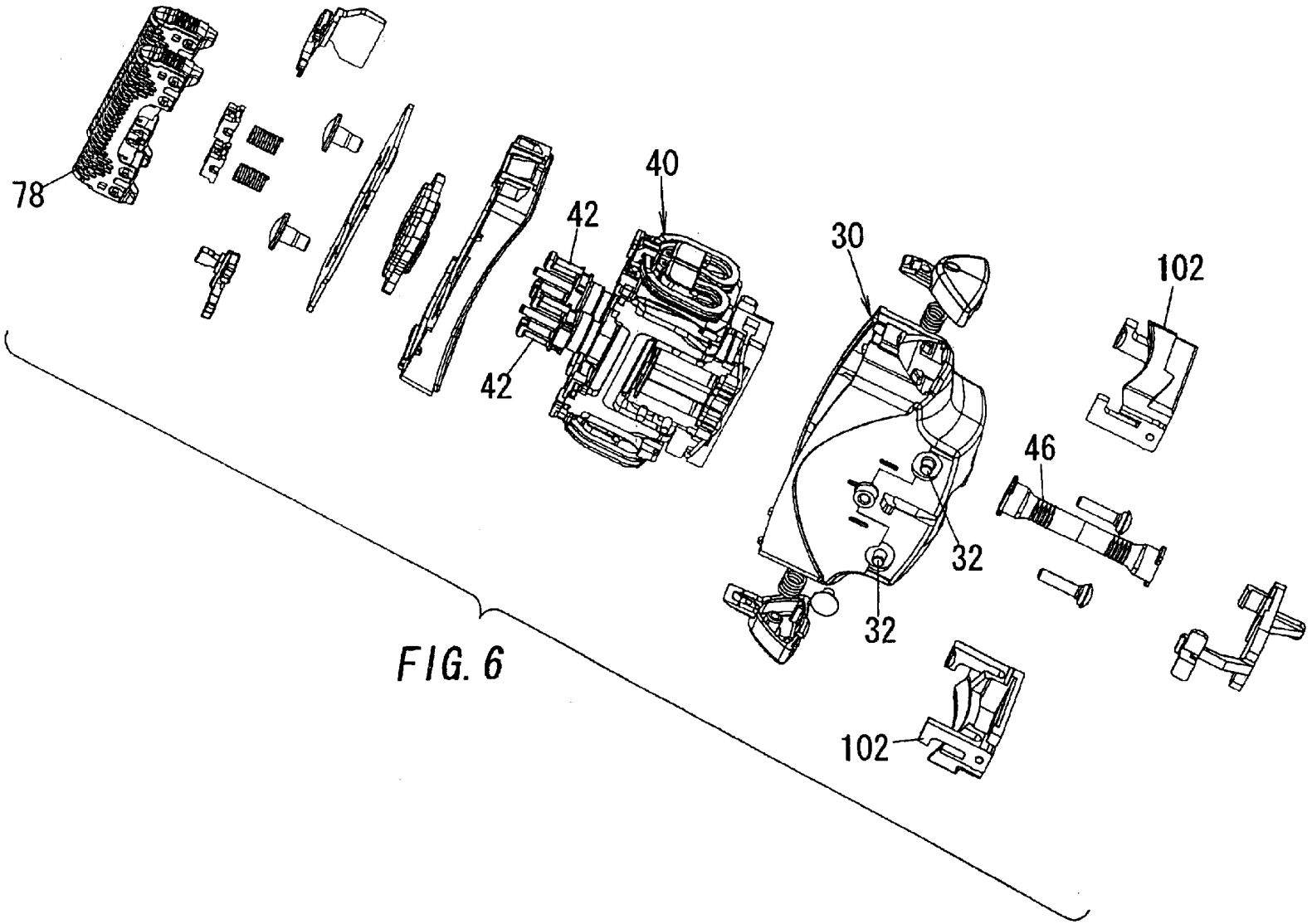
FIG. 6 is an exploded perspective view of a shaving head of the dry shaver.

As shown in FIG. 3, the supporting mechanism 100 includes a pair of levers 102 depending from the lower end of the shaving head 30, and a pair of anchors 112 which are secured to the upper end of the hand grip 10 and have vertical rods 113. The levers 102 are pivotally connected at their upper ends respectively to pins 32 projecting on the lower end of the shaving head 30 at points spaced along the width axis of the shaving head so that each lever 102 can pivot about a swivel axis S extending parallel to the thickness axis of the hand grip 10. The lower end of each lever 102 is slidably engaged with each of the vertical rods 113 with a coil spring 114 interposed between the lever 102 and the anchor 112.

Figure 7:
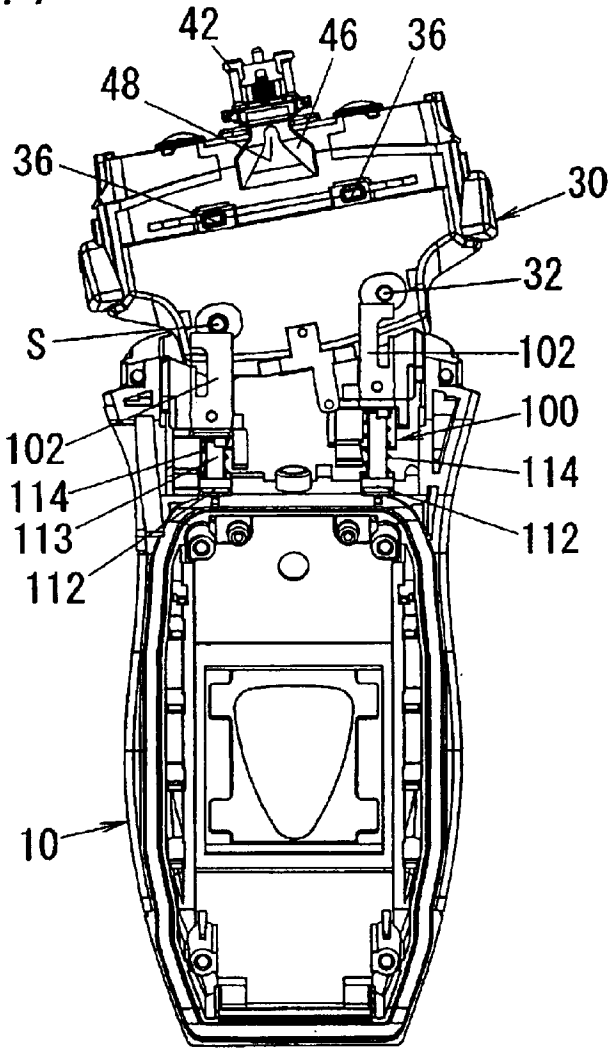
FIG. 7 illustrates the swivel movement of a shaver head of the dry shaver.

Each lever 102 is cooperative with the vertical rod 113 of the anchor 112 to define a compressible bar which supports the shaving head 30 floatingly on top of the hand grip 10, allowing the shaving head 30 to be depressed from a neural position against a bias of the coil springs 114. At the neutral position or non-depressed position, the shaving head 30 has its width axis kept perpendicular to the height axis of the hand grip 10, as shown in FIG. 3. Further, the levers 102 are pivoted at their respective upper ends to the shaving head 30 with some tolerance given about at least one of the pins 32 such that the shaving head 30 can swivel about either one of the pins 32 or the swivel axis S of the corresponding one of the levers 102, while lowering the other lever 102 with associated compression of the coil spring 114. Whereby, the shaving head 30 is allowed to swivel in either directions with associated inclination of the shaving units 70 and 80 relative to the height axis of the hand grip 10, as shown in FIG. 7. Because of that the swivel movement of the shaving head 30 is accompanied with the compression of the coil spring 114, the shaving units are given a suitable contact pressure as the shaving head 30 is angled. Also, because of that each lever 102 is vertically movable, the shaving head 30 is allowed to swivel about either of the vertically displaced swivel axis S, that is, the shaving head 30 can swivel at a varying depressed position. The support mechanism 100 includes an adjustor 120 which actuates U-shaped leaf springs 106 selectively to give a spring force which is additive to that of the coil spring 114 for adjusting the resulting contact pressure given to the shaving units. The springs 114 and 106 give a biasing force for urging the shaving head 30 to the neural position.

Figure 8:
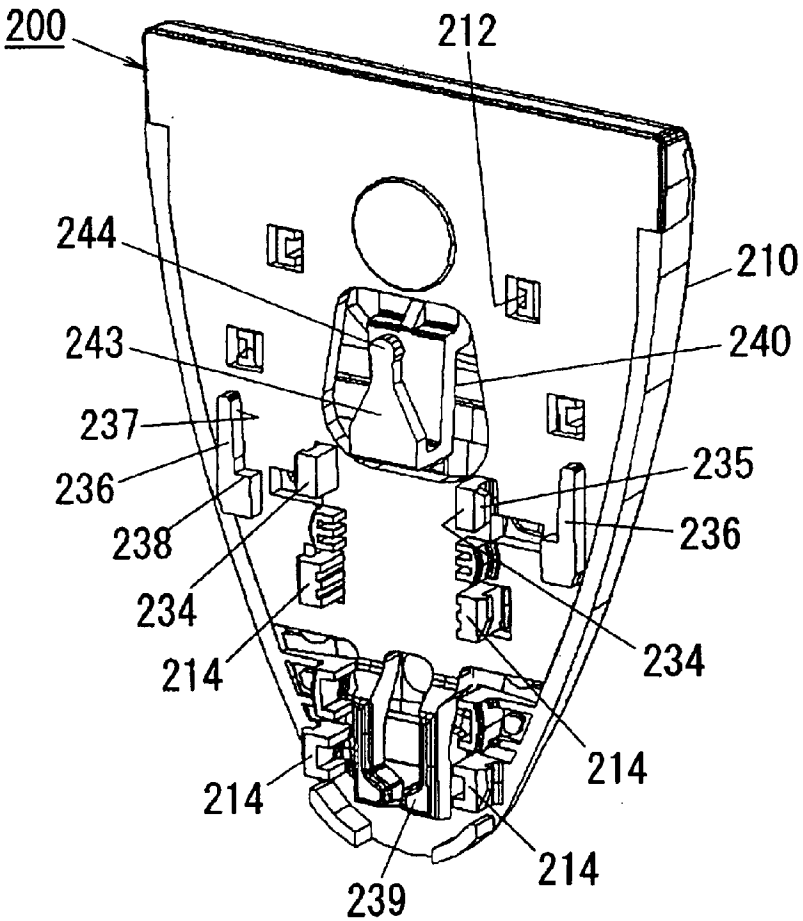
FIG. 8 is a perspective view of a trimmer unit of the dry shaver.
Figure 9:
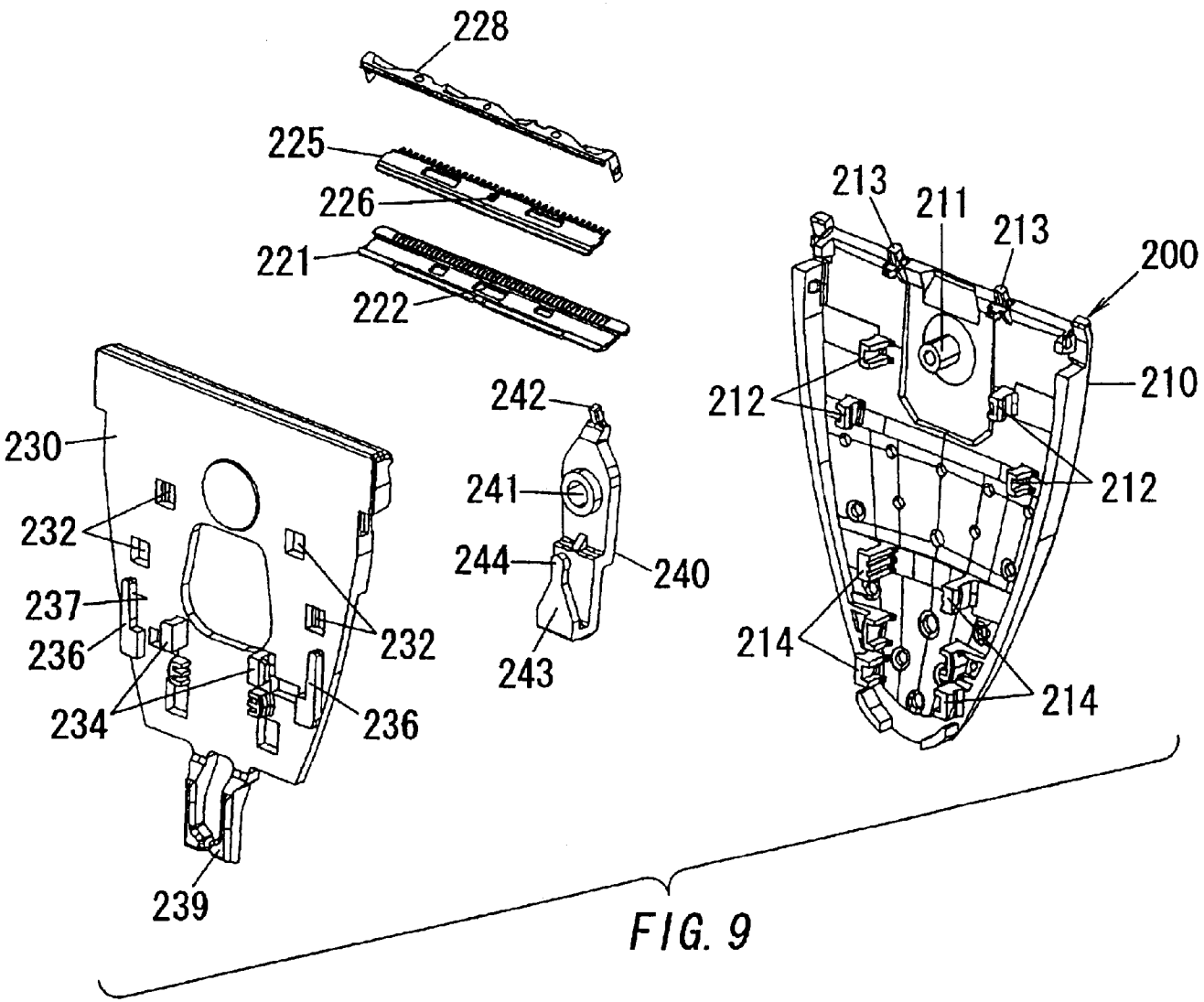
FIG. 9 is an exploded perspective view of the trimmer unit.
Figure 11:
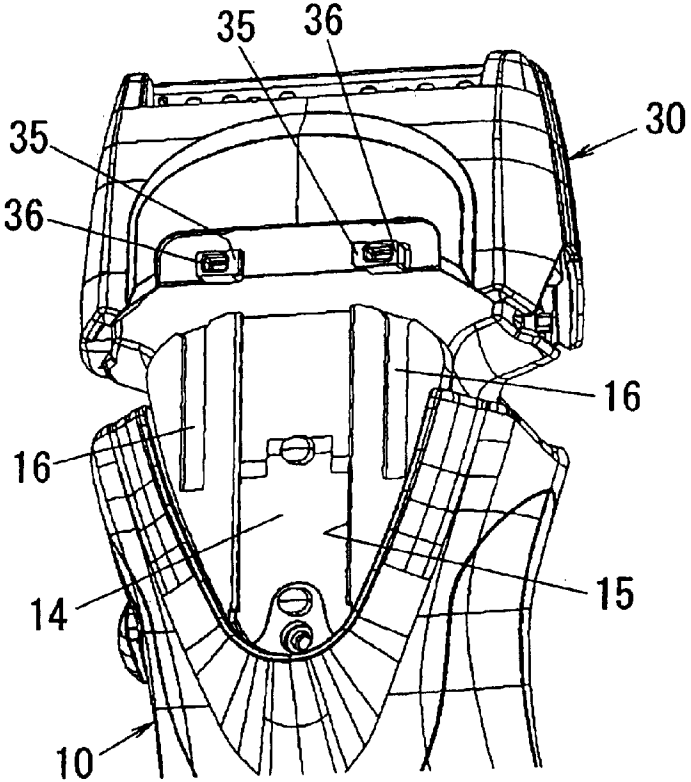
FIG. 11 is a perspective view of the shaving head held in straight relative to the hand grip.

Now referring to FIGS. 8 and 9, the trimmer unit 200 will be now explained in detail. The trimmer unit 200 is supported to the hand grip 10 to be vertically movable between a lowered rest position and a raised operative position. In the rest position, the trimmer unit 200 is disconnected from the drive element 42 and is kept disabled. When the trimmer unit 200 moves into the operative position where the upper end of the trimmer unit 200 projects above the shaving head 30, it is drivingly connected to the drive element 42 and is enabled for making the hair trimming.

The trimmer unit 200 is composed of a base 210 carrying the trimmer cutter at its upper end and a lid 230 which is secured to the base 210 while accommodating a swing arm 240 therebetween. The trimmer cutter is composed of a stationary toothed blade 221 and a movable toothed blade 225 which is held slidable on the stationary blade 221 by means of a biasing spring 228. The length of the blade defines a width axis of the trimmer unit 200 which is perpendicular to the upright axis of the hand grip 10. The swing arm 240 is formed at a portion intermediate its length with a bearing hole 241 for receiving a pivot pin 211 projecting on the base 210 so that the swing arm pivots about an axis perpendicular to the width axis of the trimmer unit 200 as well as the upright axis of the hand grip 10. The swing arm 240 has at its upper end a hook 242 that extends loosely through a center slot 222 of the stationary blade 221 and is secured into a center hole 226 of the movable blade 225 for reciprocating the movable blade relative to the stationary blade, when there is established a driving connection between the swing arm 240 and the drive element 42 on the side of the shaving head 30. A pair of studs 213 on top of the base 210 extend tightly through holes 222 in the stationary blade 221 for mounting the same. The swing arm 240 is also formed at its lower end with a coupler 243 that extends in an overlapped relation with the swing arm and has at its top a knob 244 for detachable engagement with an extension 46 secured to one of the drive elements 42.

Figure 10:
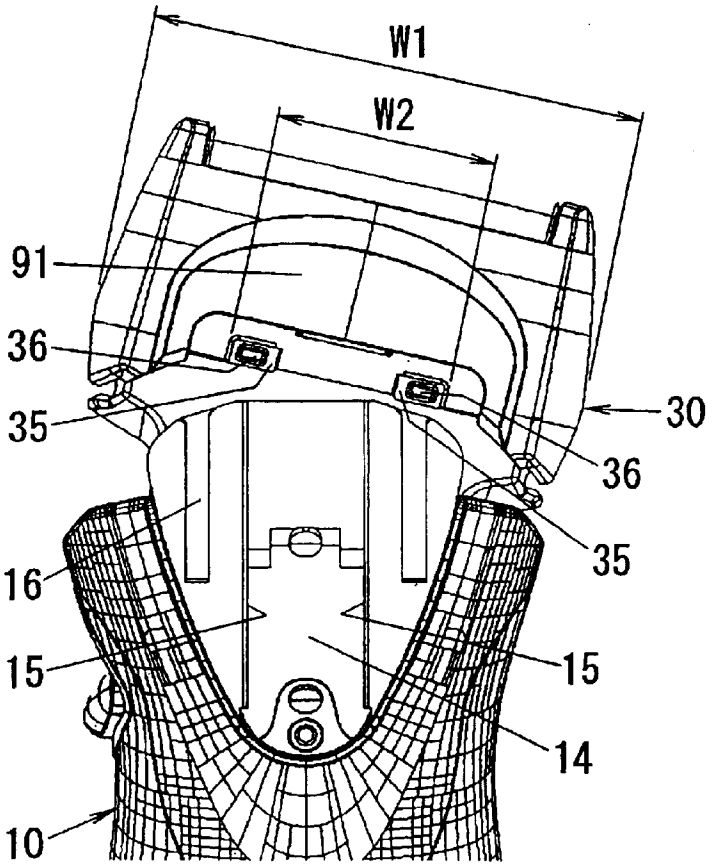
FIG. 10 is a rear view of the shaving head inclined relative to a hand grip.
Figure 13:
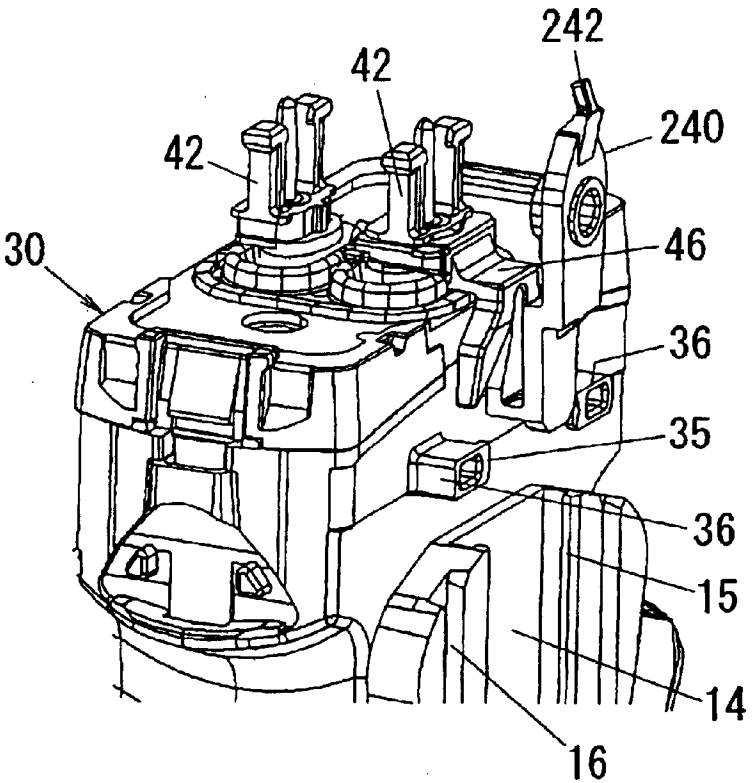
FIG. 13 illustrates a relation between the shaving head and the trimmer unit in its operative position.

The base 210 are formed at its upper area with snap projections 212 which snap respectively into holes 232 of the lid 230 for securing the lid to the base, and are also formed at its lower area with guide projections 214 which project out of the lid 230 through openings or directly for sliding engagement into a vertical supporting groove 14 formed in the rear of the hand grip 10, as shown in FIGS. 9 and 10. In addition, the lid 230 is formed with like guide projections 234 which are also made for sliding engagement with the supporting groove 14. Each of the guide projections 214 and 234 is shaped to have an outwardly extending flap 235 that engages with corresponding one of flanges 15 on opposite edges of the groove 14 for guiding the trimmer unit smoothly between the rest position and the operative position, while retaining the trimmer unit 200 on the rear of the hand grip 10. Depending from the lid 23 is an anchor hook 239 which comes into latching engagement with corresponding members on the side of the hand grip for temporarily latching the trimmer into either of the rest or the operative position.

Figure 14:
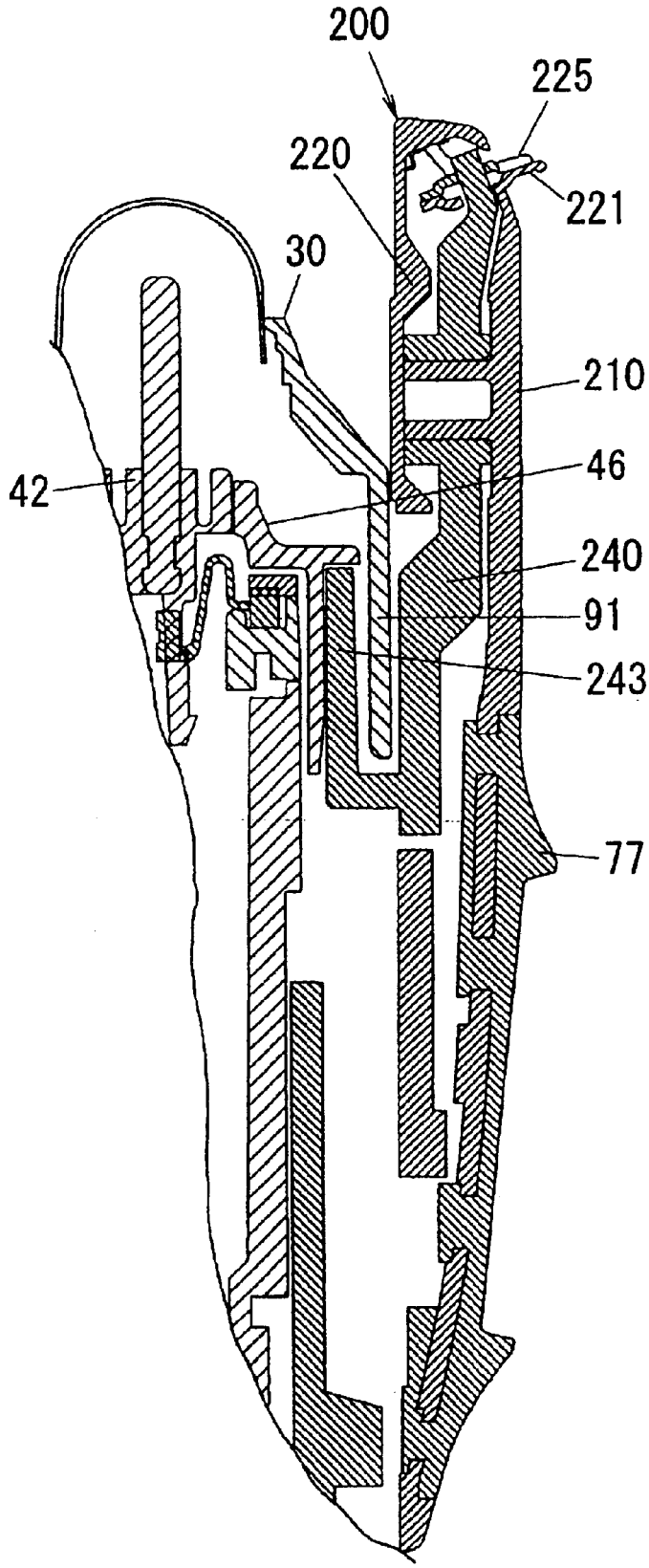
FIG. 14 is a sectional view of the trimmer unit in its operative position.
Figure 15A:
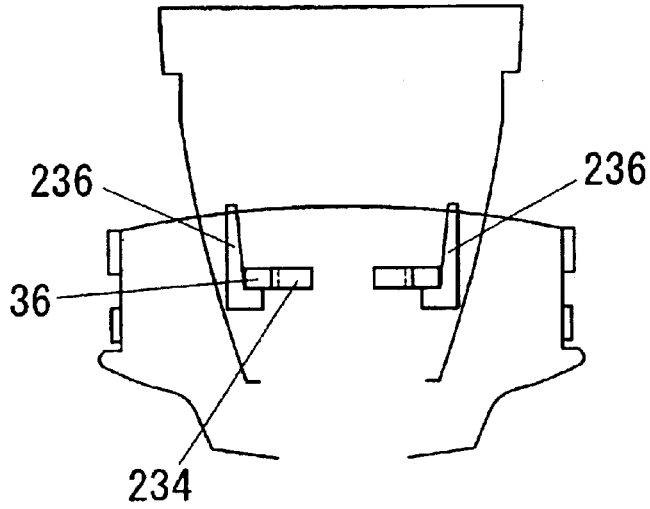
FIGS. 15A to 15C illustrate a mechanism for locking and unlocking the shaving head.
Figure 15B:
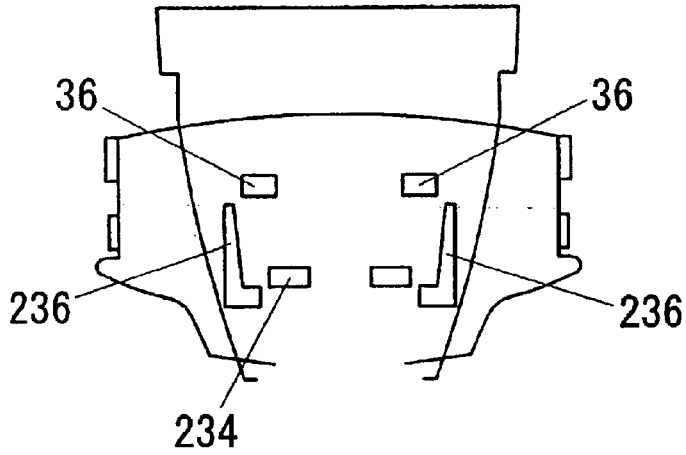
Figure 15C:
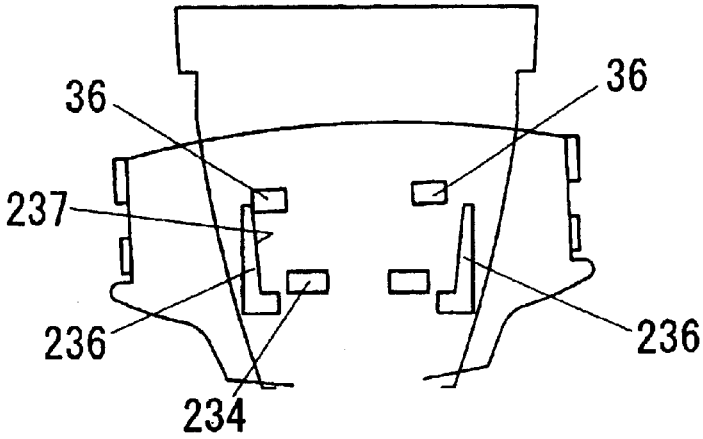

Further, the lid 230 is formed with a pair of lock members 236 spaced in the width axis and located outwardly of the adjacent guide projections 234. The lock members 236 are provided in order to lock the shaving head 30 into the neutral position only when the trimmer unit 200 is held in the operative position. In the rest position, the lock members 236 are received respectively within vertical slots 16 formed in the rear of the hand grip 10 outwardly of the groove 14. When the trimmer unit 200 moves into the operative position, the lock members 236 advance out of the slots 16 and come into friction engagement respectively with catch members 36 projecting on the rear of the shaving head 30, as shown in FIGS. 10 to 13, and 15A. Whereby, the shaving head 30 is locked into the neutral position to have its width axis kept in substantially parallel with the width axis of the trimmer unit 200 so that the drive element 42 and the extension 46 reciprocate exactly along the width axis, thereby transmitting the full stroke of the drive element to the trimmer cutter by way of the swing arm 240 for effectively driving the trimmer cutter, i.e., the movable blade 225. Also in the operative position, the upper guide projections 234 of the trimmer unit 200 is held in locking engagement respectively with the inner ends of the same catch members 36 for successfully locking the shaving head 30 in the neutral position, as shown in FIG. 15A. When the trimmer unit 200 moves back into the rest position, the lock members 236 and the guide projections 234 are released from the catch members 36, as shown in FIG. 15B, allowing the shaving head 30 to move relative to the hand grip 10 in the manner as explained in the above. When the user attempts to move the trimmer unit 200 into the operative position with the shaving head 30 being kept inclined relative to the hand grip 10, i.e., while the shaving head is being pressed against the skin, the shaving head 30 can be forced to return into the neutral position by a guiding action of the lock members 236, as shown in FIG. 15C. For this purpose, the lock members 236 are formed to extend vertically and to have elongated contact surfaces 237 which are inclined with respect to the upright axis of the trimmer unit 200 such that a distance between the contact surfaces of the opposed lock members 236 are wider towards the upper ends of the lock members than at the lower ends thereof. Thus, even if the shaving head 30 is inclined when the trimmer unit 200 is moving to the operative position, one of the lock members 236 acts first to entrap the catch members 36 at its upper end, as shown in FIG. 14C, and then to turn the shaving head towards its neutral position as the catch member 36 is guided along the length of lock member 236 until it is held against a stop 238 at the lower end of the lock member 236.

Also with the provision of the inclined contact surfaces 237, the trimmer unit 200 can move in the direction away from the operative position upon seeing an external force resulting from the forced movement of the shaving head out from the neutral position, thereby protecting the parts for making driving connection between the shaving head and the trimmer unit as well as the parts for locking the shaving head in the neutral position. It should be noted in this connection that the flaps 235 of the guide projections 234 engage with flanges 35 at the inner ends of the catch members 36, thereby holding the trimmer unit 200 in a predetermined spaced relation from the shaving head and therefore keeping the trimmer unit 200 from escaping away from the shaving head 30 in combination of the other guide projections 234 engaging at the individual flaps 235 with the associated flanges 15 of the groove 14. As shown in FIG. 10, the distance W2 between the outer edges of the catch members 36, i.e., the distance between the associated lock members 136 is selected to be one-half or more of the width W1 of the shaving head 30 for the successful locking of the shaving head 30 as well as for the safe releasing of the trimmer unit 200 from the operative position in association with the forced movement of the shaving head 30.

Figure 12:
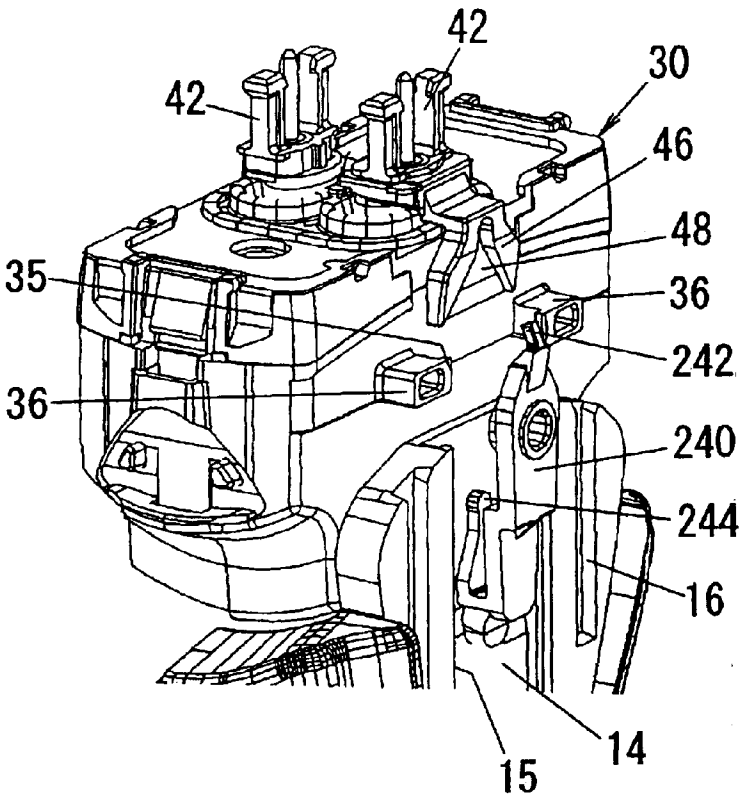
FIG. 12 illustrates a relation between the shaving head and the trimmer unit in its rest position.

The drive element 42 and the extension 46 are concealed behind a cover 91 formed at the rear lower end of the cutter holder 90. As best shown in FIG. 12, the extension 46 has a vertical member with a flared slot 48 which receives therein the hook 242 at the upper end of the swing arm 240 for establishing the driving connection between the drive element 42 and the movable blade 225 as a consequence of the trimmer unit 200 being moved into the operative position. With the provision of the cover 91, the connection between the swing arm 240 and the drive member 42 can be isolated from the upper cutting areas of the trimmer unit and the shaving head, as shown in FIG. 14, and therefore can be relatively free from hairs just trimmed or shaved. Further, the base 210 of the trimmer unit is partly made of an elastomeric material 218 for absorbing vibration noises.

Figure 16:
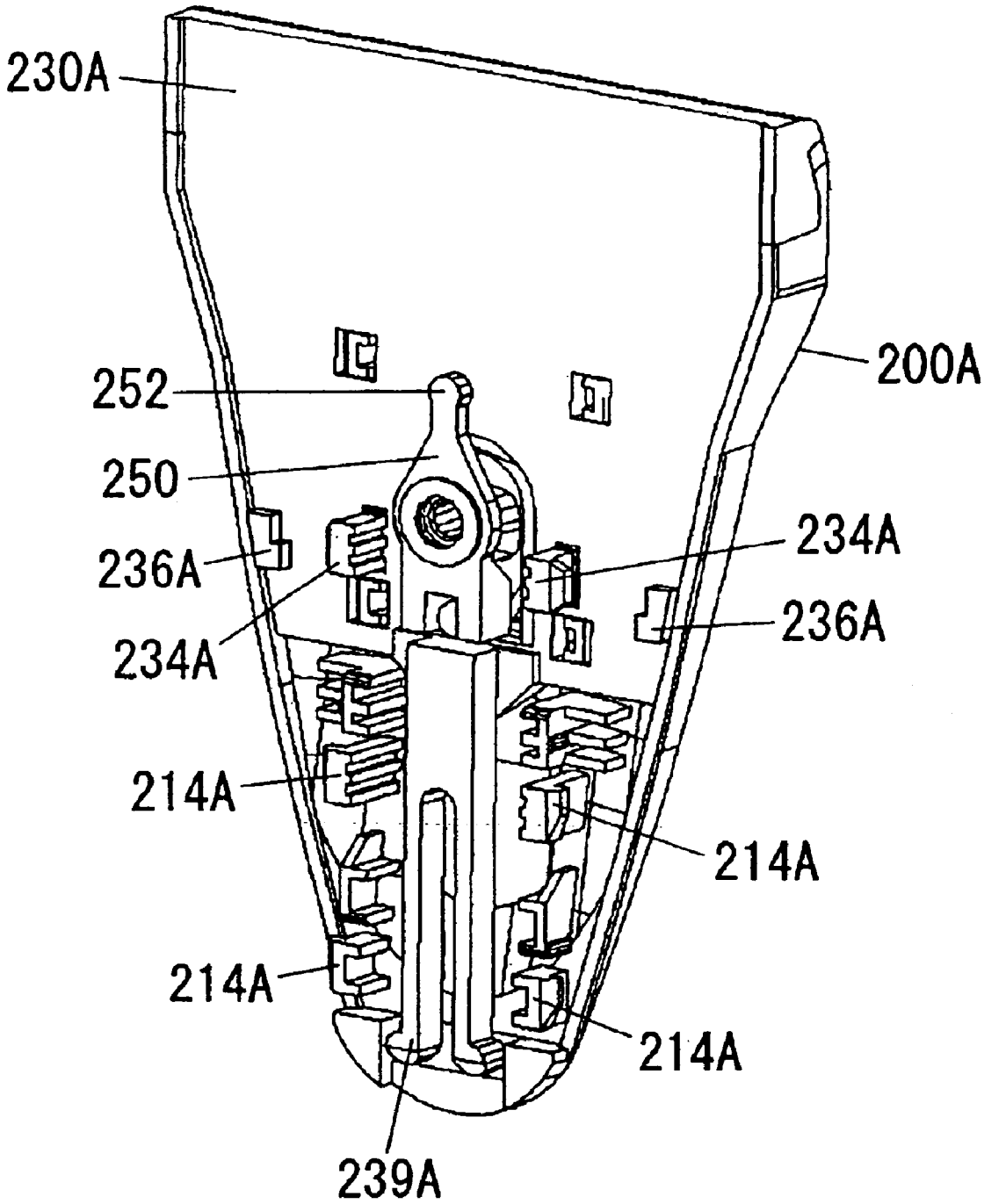
FIG. 16 is a perspective view of another trimmer unit which may be utilized in the dry shaver.
Figure 17:
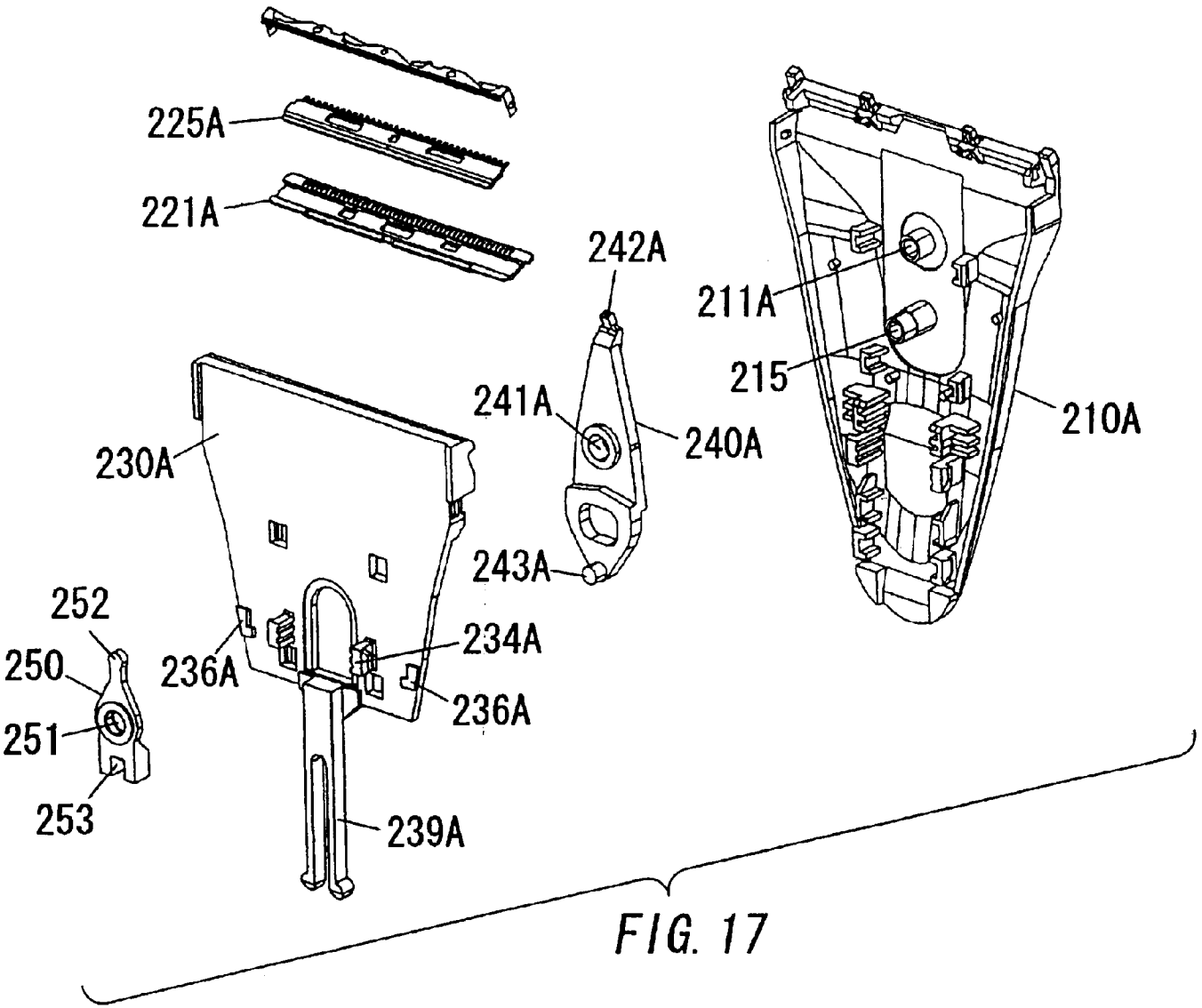
FIG. 17 is an exploded perspective view of the trimmer unit.

FIGS. 15 and 16 illustrate a modified trimmer unit 200A which can be equally applied to the above-described shaver and which is basically identical to that disclosed in the above embodiment except for a structure that transmits the oscillating movement of the drive element 42 to the trimmer cutter, i.e., the movable blade 225A. The structure includes a first swing arm 240A and a second swing arm 250 both of which are pivotally supported to the base 210A of the trimmer unit and are linked with each other. Like parts are designated by like reference numerals with a suffix letter of "A". The first swing arm 240A has a bearing hole 241A intermediate its length for receiving a first pivot pin 211A on the base 210A, and is formed at its upper end with a hook 242 for connection with the movable blade 225A. The first swing arm 240A is formed at its lower end with a pin 243A for pivotal engagement with a slot 253 at the lower end of the second swing arm 250. The second swing arm 250 is pivotally supported at a portion intermediate its length to the base 210A by means of a second pivot pin 215 extending into a bearing hole 251 of the second swing arm 250. Formed at the upper end of the second swing arm 250 is a coupler 252 for engagement with the extension 46 on the side of the shaving head 30 in the same manner as explained in the above.

Although the present invention is explained with reference to the illustrated embodiment where the shaving head can swivels about either of two axes with or without being accompanied with depressing movement, the present invention should not limited to the specific movement relative to the hand grip, and accordingly can encompass any type of the relative movement of the shaving head. Further, the trimmer unit is disclosed as being vertically movable between the rest position and the operative position, the trimmer unit can be supported to the hand grip by means of a pop-up structure where the trimmer unit can pivot between the rest and operative positions about a pivot axis extending, for example, in parallel with the width axis of the trimmer unit or the hand grip.

What is claimed is:

1. A dry shaver with a trimmer, said dry shaver comprising:

a hand grip;

a shaving head mounted on top of said hand grip to be movable relative thereto, said shaving head including a cutter, a motor and a drive element which transmits a motion of the motor to said cutter for shaving; and a trimmer unit mounted on one side of said hand grip to be movable relative thereto between a rest position and an operative position, said trimmer unit having a trimming cutter which is drivingly connected with said drive element to be driven thereby for trimming only when said trimmer unit is in the operative position, wherein a lock device is provided to interlock said trimmer unit and said shaving head for holding said shaving head in a fixed position relative to said hand grip when said trimmer unit is in said operative position.

2. The dry shaver as set forth in claim 1, wherein said shaving head has a width axis along which said drive element reciprocates, said trimmer unit has a width axis along which said trimming cutter reciprocates, said shaving head swivels relative to said hand grip about a pivot axis perpendicular to said width axis of said shaving head, and said shaving head is biased into a neutral position where said lock device interlocks the trimmer unit with said shaving head and where the width axis of the shaving head is parallel with the width axis of said trimmer unit in said operative position.

3. The dry shaver as set forth in claim 2, wherein said drive element is concealed behind a cover of said shaving head and is accessible through a lower opening at a lower end of said cover, said trimmer unit retains a link for connecting said trimming cutter to said drive element, said link includes a swing arm which is pivotally supported to said trimmer unit at a portion intermediate an upper and a lower end thereof, and which is connected at its upper end with said trimming cutter, said link further includes a coupler which extends integrally from the lower end of the swing arm upwardly in an overlapped relation with the swing arm, and said coupler extends through said lower opening for engagement with said drive element when said trimmer unit moves into the operative position.

4. The dry shaver as set forth in claim 2, wherein said drive element is concealed behind a cover of said shaving head and is accessible through a lower opening at a lower end of said cover, said trimmer unit retains a link for connecting said trimming cutter to said drive element, said link includes a first swing arm which is pivotally supported to said trimmer unit at a portion intermediate an upper and a lower end thereof, and which is connected at its upper end with said trimming cutter, said link further includes a second swing arm which is pivotally supported to said trimmer unit at the portion intermediate the upper and the lower ends thereof, and which is pivotally connected at its lower end to a lower end of said first swing arm, and said second swing arm has at its upper end a coupler which extends through said lower opening for engagement with said drive element when said trimmer unit moves into the operative position.

5. The dry shaver as set forth in claim 1, wherein said lock device includes a guide and a lock both formed on one side of said trimmer unit, said guide is held in constant engagement with a support formed on the side of said hand grip onto which the trimmer unit is mounted, and said lock comes into engagement with a catch formed on the said shaving head when said trimmer unit moves into the operative position.

6. The dry shaver as set forth in claim 5, wherein said lock is engaged with said catch to hold said trimmer unit in a predetermined spaced relation to said shaving head.

7. The dry shaver as set forth in claim 5, wherein said lock comprises a pair of lock members for engagement with a corresponding pair of catch members defining said catch, and said pair of lock members is spaced along a width axis of said shaving head by a distance of one half or more of a width of said shaving head.

8. The dry shaver as set forth in claim 5, wherein said trimmer unit is slidably supported to said hand grip to be vertically movable between the rest position and the operative position along an upright axis of said hand grip, said lock comprises a pair of lock members for engagement with a corresponding pair of catch members defining said catch, each of said pair of lock members is formed with a contact surface for friction engagement with each of the corresponding pair of catch members, and said contact surface is inclined with respect to the upright axis of said hand grip in such a direction that the pair of lock members is released from said corresponding pair of catch members when said shaving head is forced to swivel relative to said hand grip.

9. The dry shaver as set forth in claim 1, wherein said trimmer unit includes a vibration absorbing member of an elastomeric material.

* * * * *